United States Patent [19]

Odencrantz

[11] 4,104,744

[45] Aug. 8, 1978

[54] WASHING DEVICE

[76] Inventor: Clyde Odencrantz, 357 W. 29th St., New York, N.Y. 10001

[21] Appl. No.: 763,410

[22] Filed: Feb. 15, 1977

[51] Int. Cl.[2] ..... A45D 19/00

[52] U.S. Cl. ..... 4/159; 239/373; 239/571

[58] Field of Search ..... 4/159; 239/337, 373, 239/571, 346, 355, 351

[56] References Cited

U.S. PATENT DOCUMENTS

| | | | |
|---|---|---|---|
| 2,976,897 | 3/1961 | Beckworth | 239/373 |
| 3,322,349 | 5/1967 | Knibb | 4/159 |
| 3,394,888 | 7/1968 | Dasse et al. | 239/571 X |
| 3,445,065 | 5/1969 | Waldrum | 239/571 X |
| 3,705,689 | 12/1972 | Lee | 239/373 |

FOREIGN PATENT DOCUMENTS

| | | | |
|---|---|---|---|
| 12,123 | 9/1928 | Australia | 239/373 |
| 371,707 | 1/1907 | France | 239/373 |
| 1,326,346 | 8/1973 | United Kingdom | 4/159 |

*Primary Examiner*—William D. Martin, Jr.
*Attorney, Agent, or Firm*—Robert D. Farkas

[57] ABSTRACT

A portable washing device comprising a sealable fluid chamber filled with liquid to a given level. An air pump increases the air pressure above the liquid and at a preselected value forces the liquid through a check valve, hose and spray head for washing. A safety relief valve in the chamber prevents the air pressure from exceeding a predetermined value.

4 Claims, 3 Drawing Figures

WASHING DEVICE

BACKGROUND OF THE INVENTION

The present invention relates to washing devices.

Washing devices of the type having a chamber for storing the washing liquid are known in the prior art but these do not utilize both the displacement or washing liquid by pressurized air as a method of forcing the liquid from the chamber under pressure and valves to control the water pressure.

Among those prior art devices that do not teach the use of air displacement for moving water are U.S. Pat. Nos. 2,033,812; 2,607,043; 2,850,742 and 3,192,537 which utilize rotary water pumps.

SUMMARY OF THE INVENTION

It is the principal object of this invention to provide a portable washing device that provides a stream of washing liquid discharging at a given pressure minimum.

It is a further object to provide means for establishing a maximum pressure for the discharging liquid.

These and other objects are achieved by the preferred embodiment of the invention in which an air-tight fluid chamber is provided that is fillable with washing liquid to a given level. An air pump increases the pressure of the air above the liquid surface. A check valve set to a predetermined pressure value will operate to allow the liquid to discharge a said predetermined pressure. A settable air pressure relief valve prevents the air pressure from exceeding the set pressure.

Having in mind the above and other objects that will be obvious from an understanding of the disclosure, the present invention comprises a combination and arrangement of parts illustrated in the presently preferred embodiments of the invention which are hereinafter set forth in sufficient detail to enable those skilled in the art to clearly understand the function, operation, construction and advantages of it when read in conjunction with the accompanying drawings.

BRIEF DESCRIPTION OF THE DRAWING

The invention will be described in detail, by way of example, with reference to the accompanying drawing in which.

DETAILED DESCRIPTION OF THE INVENTION

Figure 1:
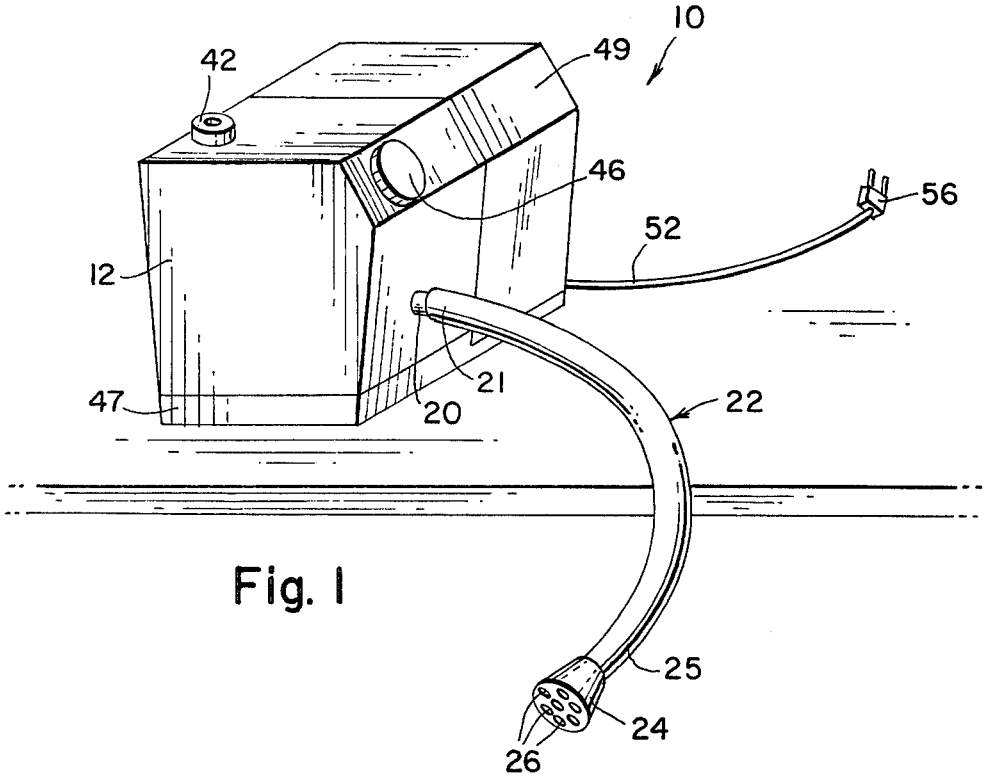
FIG. 1 is a pictorial view of the washing device.
Figure 2:
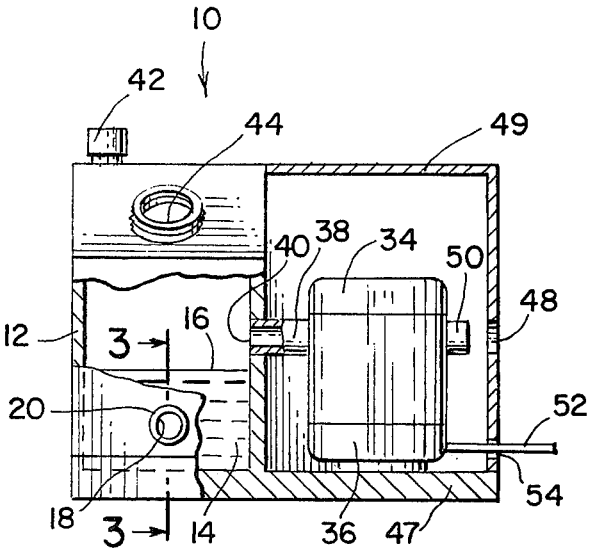
FIG. 2 is a partial front section view illustrating the principles of the invention.
Figure 3:
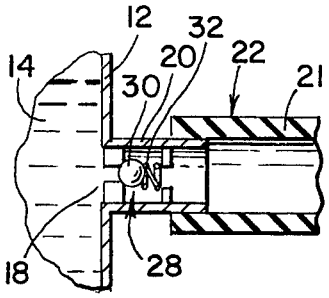
FIG. 3 is a partial section view taken across line 3—3 in FIG. 2.

Referring to FIGS. 1–3 of the drawing and in accordance with the principles of the invention, a washing device 10 is shown comprising a sealable airtight fluid chamber 12 normally filled with air and capable of being filled with a washing liquid 14 such as water or a detergent solution, to a given level 16. Below that level 16 an exit port 18 is disposed through a wall of the chamber 12. Attached to the nipple 20 affixed to the exit port 18 is one end of a hose 22 that has a spray head 24 attached to its other end 25. The spray head 24 includes a plurality of nozzle apertures 26 at its discharge end. A check valve 28 is positioned between the other end 21 of the hose 22 but preferably in the exit port. The check valve 28 operates to permit the flow of water 14 out of the chamber 12 when the water pressure equals or is greater than the pressure determined by the valve ball 30 compressing the valve spring 32 to open a fluid passageway to the spray head 24. Adjusting means, not shown, may be utilized to set the minimum pressure of the discharged water.

Pressure is created in the device 10 by pumping air into the chamber 12 above the given level 14 by means of an air pump 34 driven by an electric motor 36. The pump 34 may be a piston, diaphragm or other commercially available types and must have sufficient capacity to provide pressure on the water surface that is at least equal to the operating pressure of the check valve 28. The pump 34 pressure outlet 38 is connected to an aperture 40 in the chamber 12 to put them in fluid communication. Air pumps 34 are advantageous in a washing device 10 such as the present invention because unlike water pumps, they are not susceptible to damage as from handling the various fluids one may encounter such as detergents, shampoos and other washing solutions as well as from solid impurities that may be present in the liquid.

Located in the upper portion of the chamber 12 are an adjustable pressure relief valve 42 and a filling aperture 44. A pressure cap 46 is connectible therewith and constructed to provide an air-tight seal around the aperture 44 when closed. The relief valve 42 is set to a predetermined pressure that is greater than check valve 28 pressure setting. In this way, the pump 34 may operate continuously to first build up the air pressure to the fluid release level and, if the pressure increases to the relief valve 42 setting, any additional air is discharged to the atmosphere. By use of these valves 28, 42 the air pressure and therefore the discharge pressure of the water 14 is confined between predetermined values independent of the liquid quantity of pump capacity or efficiency.

The chamber 12 and pump 34 and motor 36 are mounted on a base 47. A cover 49 is attached to the base 47 and encloses the pump 34 and motor 36. At least one aperture 48 is provided in the cover 49 to admit air to the intake 50 of the pump 34. The line cord 52 connects to the motor 36 and extends through the cover 49 through the apertures 48 or another opening 54 and terminates in a plug 56 for providing power to the motor 36.

In use, one fills the fluid chamber 12 to a given level 16 which may be defined by a visible reference in the chamber, a partition wall, not shown, defining separate air and water chambers that are in fluid communication. Location of the filling aperture 44 can automatically determine the maximum fill since no liquid can be filled above its height. The valves 28, 42 can be preset to the desired pressure range and the pump motor 36 energized to operate the pump 34 continuously.

While preferred and other exemplary embodiments of the invention are illustrated and/or described, it will be understood that the invention is in no way limited to these embodiments.

What is claimed is:

1. A washing device comprising a sealable fluid containing chamber normally partially filled with air and fillable with a liquid to a maximum given level and having an exit port disposed below the given level, said fluid chamber includes an aperture disposed above the given liquid level, means defining a filling aperture disposed in said fluid chamber above said given liquid level and a cap releasably connectable to said filling aperture and constructed to provide an air tight seal therebetween when connected, whereby said air pump provides said pressure in said chamber at levels greater than said release pressure when continuously operated, a hose having a first end connected to said exit port and a second end, means for increasing the pressure of the air to at least a given pressure including an air pump having a pressure outlet connected to said aperture and in air tight fluid communication with said fluid chamber, a pressure relief valve means settable to a predetermined release pressure greater than the given pressure and disposed to sense the pressure in said fluid chamber above the given liquid level thereby preventing the maximum pressure in said fluid chamber from exceeding the release pressure, check valve means disposed between said exit port and said second end of said hose and operable at the given pressure for allowing the passage of liquid through said hose and discharging out of said second end only when the air pressure is equal to or greater than the given pressure and whereby said liquid is maintained in said chamber when said air pressure is less than said given pressure.

2. The device as recited in claim 1, further including a spray head having a plurality of nozzle apertures disposed at one end and an inlet aperture disposed at the other end connected to the second end of said hose and in fluid communication therewith.

3. The device as recited in claim 1, further including a base for supporting said fluid chamber and air pump thereabove and cover means attached to said base and enclosing said air pump and including at least one aperture for permitting entrance of outside air to said pump.

4. The device as recited in claim 3, wherein said air pump is electrically driven by a motor and includes a line cord connected at one end to said motor and extending through the aperture in the cover.

* * * * *